US008649694B2

(12) United States Patent
Mitsui

(10) Patent No.: US 8,649,694 B2
(45) Date of Patent: Feb. 11, 2014

(54) IMAGE FORMING APPARATUS AND REMAINING TONER AMOUNT CALCULATING UNIT

(75) Inventor: Shinji Mitsui, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 172 days.

(21) Appl. No.: 13/279,652

(22) Filed: Oct. 24, 2011

(65) Prior Publication Data

US 2012/0243885 A1 Sep. 27, 2012

(30) Foreign Application Priority Data

Mar. 25, 2011 (JP) ..... 2011-068493

(51) Int. Cl.
*G03G 15/08* (2006.01)

(52) U.S. Cl.
USPC ..... 399/27; 399/53

(58) Field of Classification Search
USPC ..... 399/27, 262, 53
See application file for complete search history.

(56) References Cited

U.S. PATENT DOCUMENTS

2007/0081829 A1* 4/2007 Funayama et al. ..... 399/27
2008/0240760 A1* 10/2008 Tanaka ..... 399/62
2012/0251134 A1* 10/2012 Mitsui ..... 399/27

FOREIGN PATENT DOCUMENTS

JP 2001-92232 4/2001
JP 2005-173088 6/2005

* cited by examiner

*Primary Examiner* — Sophia S Chen
(74) *Attorney, Agent, or Firm* — Oliff PLC

(57) ABSTRACT

An image forming apparatus includes image holding bodies that hold latent images and toner images, developer units that form toner images by developing the latent images, a transfer unit that transfers the toner images to a recording medium, a fixing unit that fixes the transferred toner images to the recording medium, container mounting portions on which toner containers are replaceably mounted, and remaining toner amount calculating units that calculate the amount of toners remaining in the toner containers, wherein the remaining toner amount calculating unit includes a primary calculator that calculates plural primary remaining amounts on the basis of bases different from each other, a storage unit that stores empty area data of a remaining amount space, and a secondary calculator that refers to the empty area data stored in the storage unit, and calculates a ratio of a distance.

12 Claims, 14 Drawing Sheets

(FIG. 6 Continued)
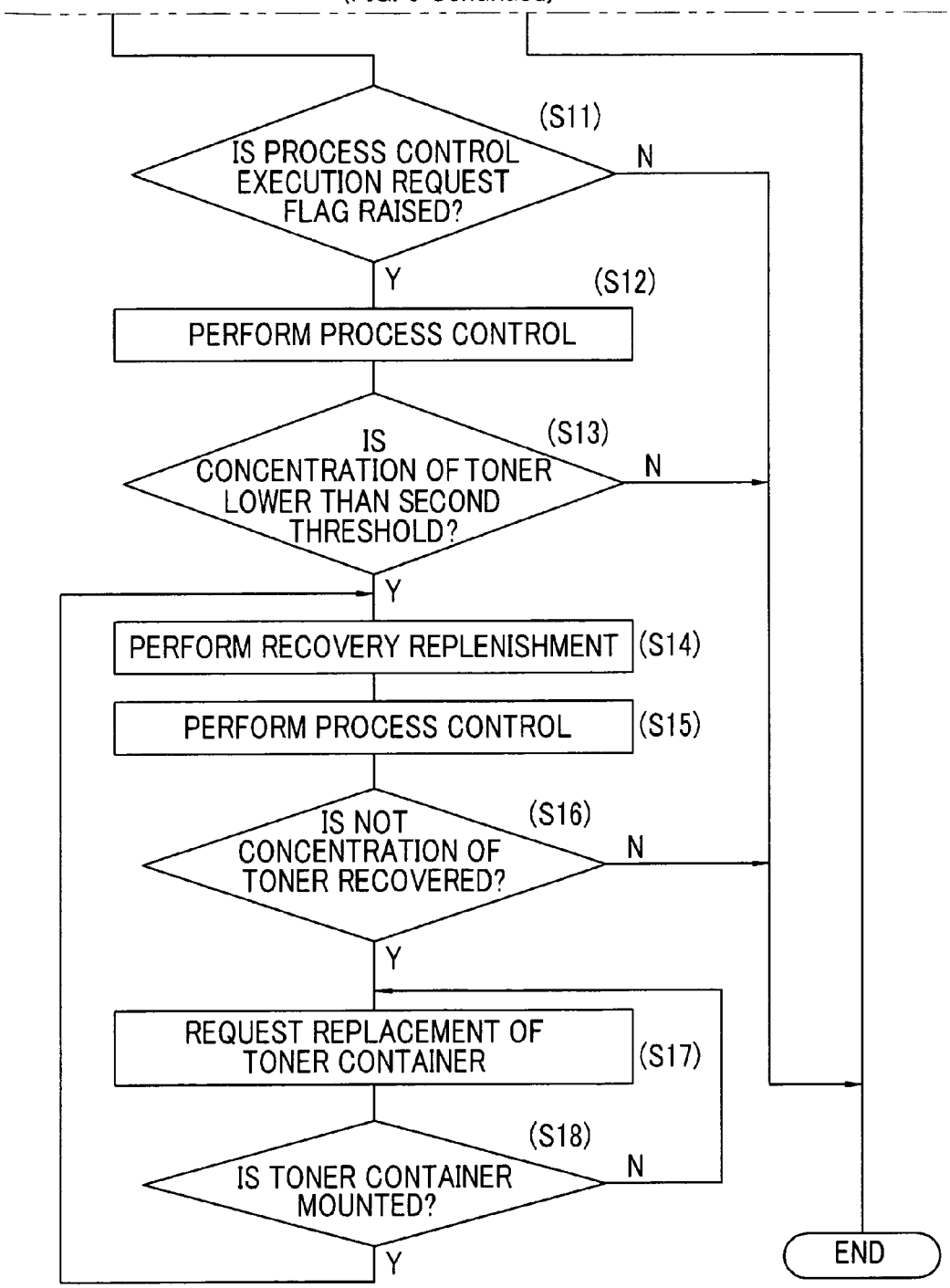

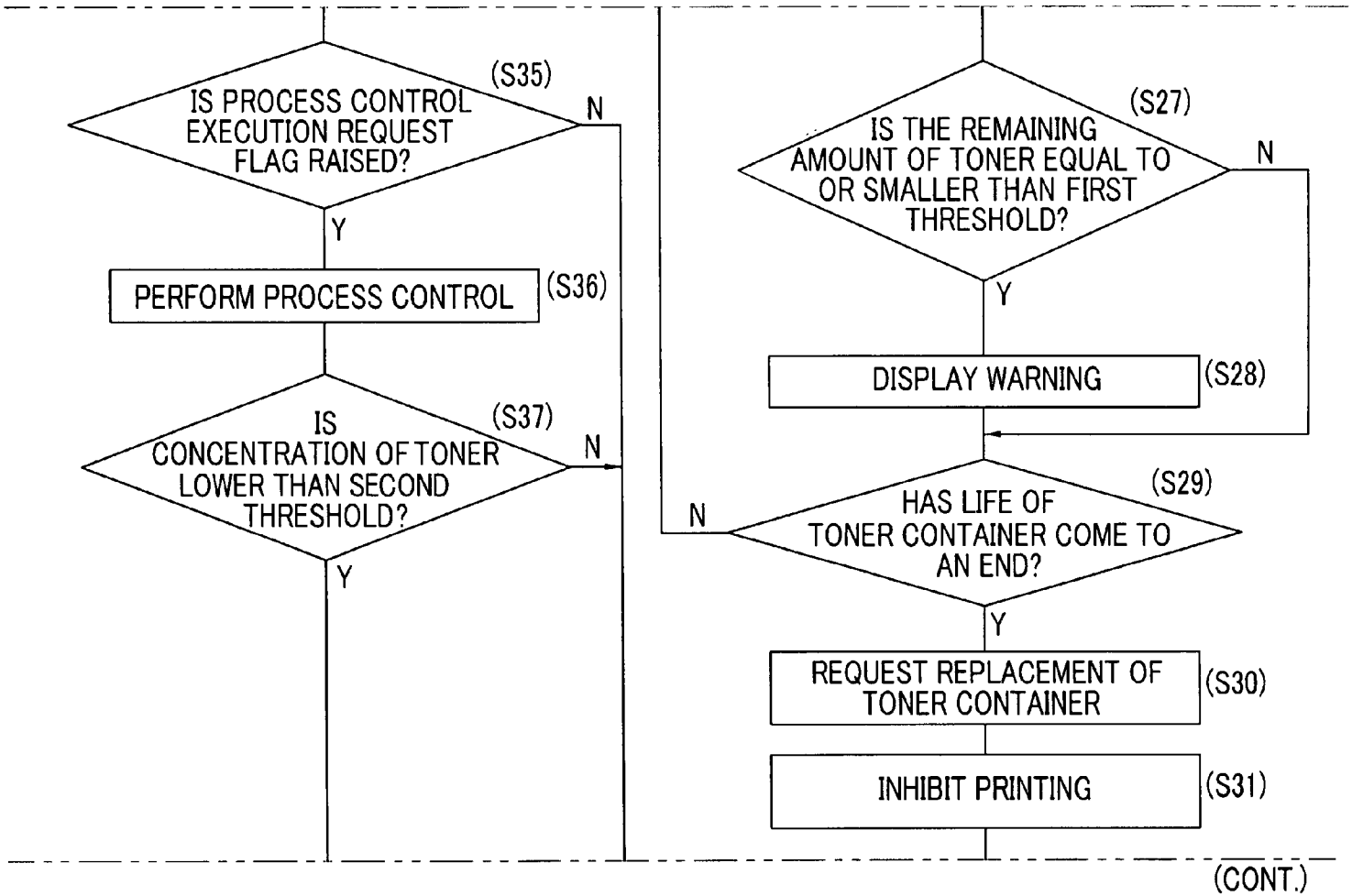
(FIG. 7 Continued)
(S27)
IS THE REMAINING AMOUNT OF TONER EQUAL TO OR SMALLER THAN FIRST THRESHOLD?
N
Y
(S28)
DISPLAY WARNING
(S29)
HAS LIFE OF TONER CONTAINER COME TO AN END?
N
Y
(S30)
REQUEST REPLACEMENT OF TONER CONTAINER
(S31)
INHIBIT PRINTING
(CONT.)
(S35)
IS PROCESS CONTROL EXECUTION REQUEST FLAG RAISED?
N
Y
(S36)
PERFORM PROCESS CONTROL
(S37)
IS CONCENTRATION OF TONER LOWER THAN SECOND THRESHOLD?
N
Y (FIG. 7 Continued)
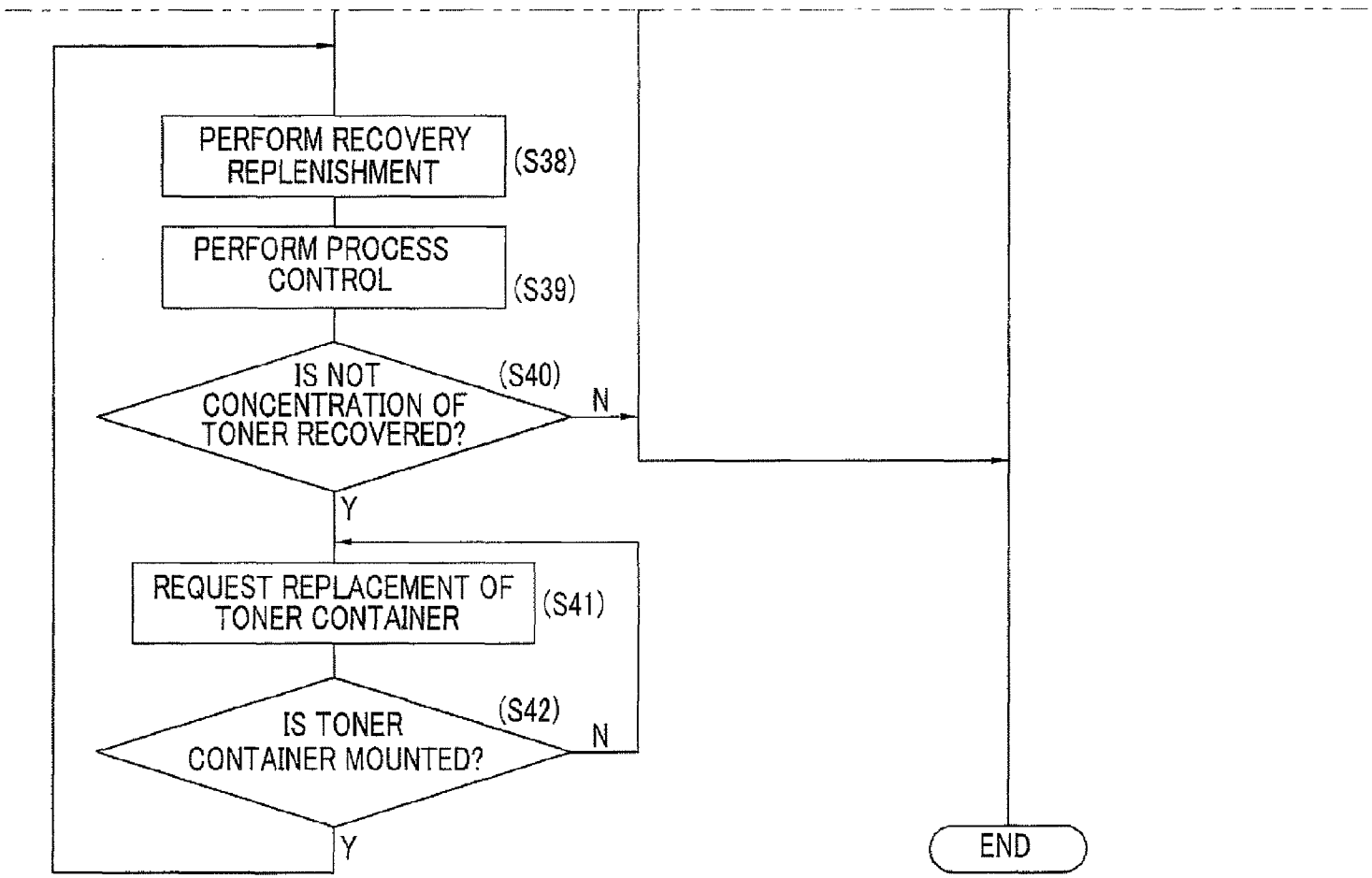

IMAGE FORMING APPARATUS AND REMAINING TONER AMOUNT CALCULATING UNIT

CROSS-REFERENCE TO RELATED APPLICATIONS

This application is based on and claims priority under 35 USC 119 from Japanese Patent Application No. 2011-068493 filed Mar. 25, 2011.

BACKGROUND (i) Technical Field

The present invention relates to an image forming apparatus.

(ii) Related Art

As an image forming apparatus, there is an image forming apparatus where toner containers storing replenishing toners are replaceably mounted and the toners are replenished to a developer unit from the mounted toner containers in accordance with the decrease of the toners in the developer unit. In the case of this type of image forming apparatus, it is necessary to facilitate the replacement of the toner container through the detection of the life (emptiness) of the mounted toner container. Further, it is preferable to warn a user of the decrease of the remaining amount of toner or to inform a user of the amount (%) of toner remaining in the toner container even before the life of the toner container has come to an end.

Here, there is proposed a technique that estimates the remaining amount of developer by counting pixels and detects the amount of developer, which remains immediately before the developer runs out, by capacitance.

Further, there is proposed a technique that predicts the remaining amount of toner from a cumulative value of the amount of replenished toner until the life of a toner cartridge becomes equal to or shorter than a threshold where there is the remaining amount of toner and predicts the remaining amount of developer at the time of emptiness from the cumulative number of pixels.

SUMMARY

According to an aspect of the invention, there is provided an image forming apparatus including: image holding bodies that hold latent images by being subjected to exposure and hold toner images by being developed with toners; developer units that form toner images by developing the latent images held on the image holding bodies with toners; a transfer unit that transfers the toner images formed on the image holding bodies to a recording medium; a fixing unit that fixes the transferred toner images to the recording medium; container mounting portions on which toner containers storing replenishing toners to be supplied to the developer unit are replaceably mounted; and remaining toner amount calculating units that calculate the amount of toners remaining in the toner containers mounted on the container mounting portions, wherein the remaining toner amount calculating unit includes a primary calculator that calculates plural primary remaining amounts by calculating the amount of toner remaining in the toner container on the basis of bases different from each other, respectively, a storage unit that stores empty area data of a remaining amount space where an empty area, where the toner container is empty, in a remaining amount space, which uses the plural primary remaining amounts as variables, is defined, and a secondary calculator that refers to the empty area data stored in the storage unit, and calculates a ratio of a distance between current coordinates and a point reaching the empty area to a distance between an origin and the point reaching the empty area on a straight line, which passes through the origin where the toner container is not in use and the current coordinates that are defined by the plural primary remaining amounts calculated in the primary calculator in the remaining amount space, as the current remaining amount of toner.

BRIEF DESCRIPTION OF THE DRAWINGS

Exemplary embodiments of the present invention will be described in detail based on the following figures, wherein.

DETAILED DESCRIPTION

An exemplary embodiment of the invention will be described below.

Figure 1:
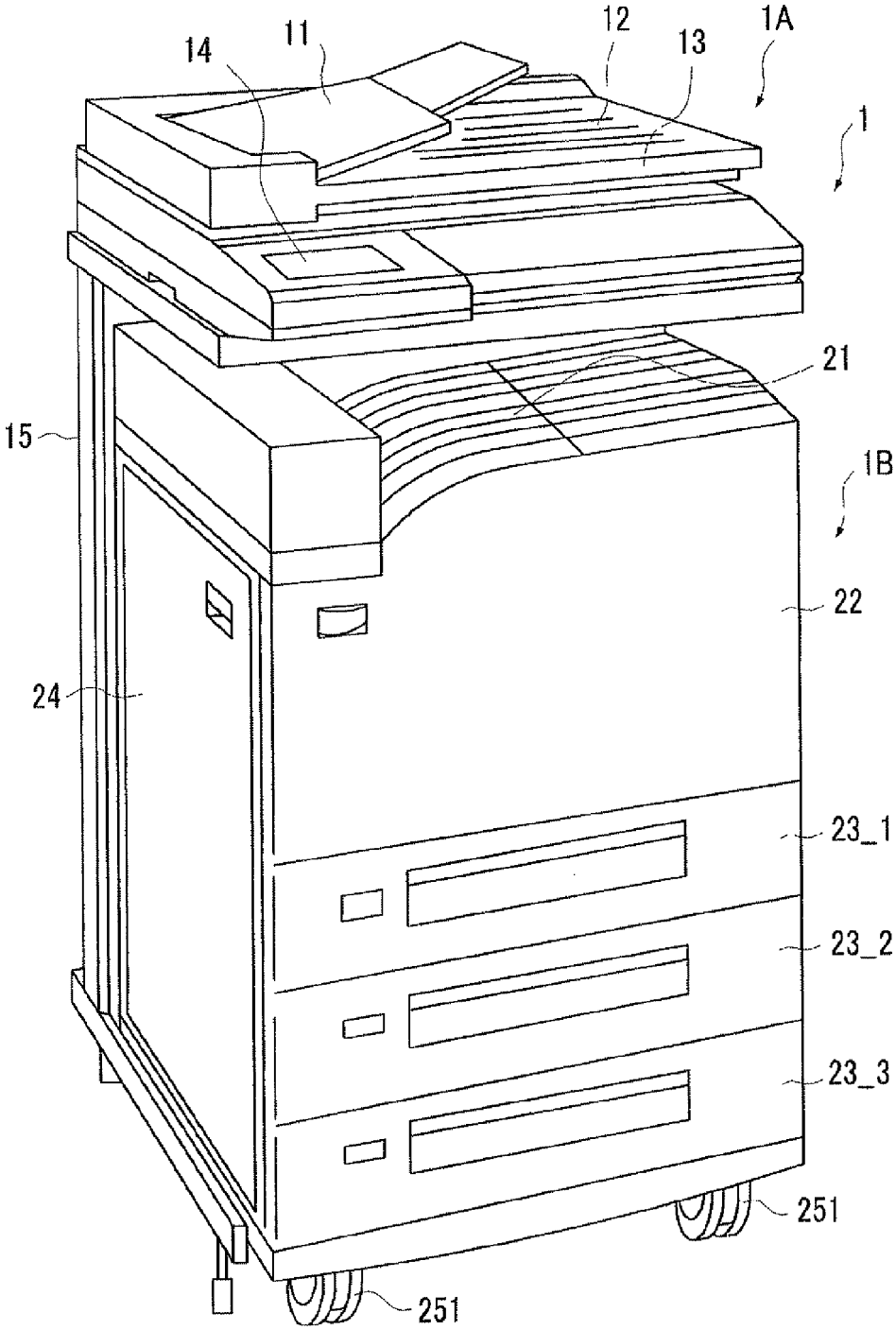
FIG. 1 is a perspective view of the appearance of a copying machine as an example of an image forming apparatus.

FIG. 1 is a perspective view of the appearance of a copying machine as an example of an image forming apparatus.

The copying machine 1 includes a document reading section 1A and an image forming section 1B.

The document reading section 1A is provided with a document feed table 11 on which documents are placed while being stacked. The documents placed on the document feed table 11 are fed one by one, letters or images recorded on the document are read out, and the document is discharged onto a document discharge table 12.

Further, the document reading section 1A includes a hinge, which extends to the left and right sides, on the back side. The document feed table 11 and the document discharge table 12 can be integrally lifted so as to rotate about the hinge as a rotation center, and a document reading plate 13 (see FIG. 2) made of transparent glass is spread below the document feed table 11 and the document discharge table 12. In the document reading section 1A, it may be possible to read letters or images from a document placed on the document reading plate 13 by placing only one document on the document reading plate 13 so that the surface of the document to be read faces downward instead of placing documents on the document feed table 11.

A display operation section 14 is provided in front of the document reading plate 13. The display operation section 14 displays various messages to a user, displays various operation buttons, and is subjected to operations, such as an instruction for reading a document and an instruction for forming an image.

The entire document reading section 1A is supported by a support frame 15.

Further, the image forming section 1B is provided with a sheet discharge table 21 to which a sheet on which an image has been formed is discharged. Furthermore, a front cover 22, which is opened to replace a part such as a toner container provided in the image forming section or remove a sheet jammed during transport, is provided on the front surface of the image forming section 1B. Moreover, three drawer type sheet feed trays 23_1, 23_2, and 23_3, in which sheets on which images are not formed yet are stored while being stacked, are housed below the front cover 22.

Further, a lateral cover 24, which is opened to remove a sheet jammed during transport, is provided on the left side surface of the image forming section 1B.

Furthermore, wheels 251, which allow the image forming section 1B to be movable, are mounted on the bottom of the image forming section 1B.

Figure 2:
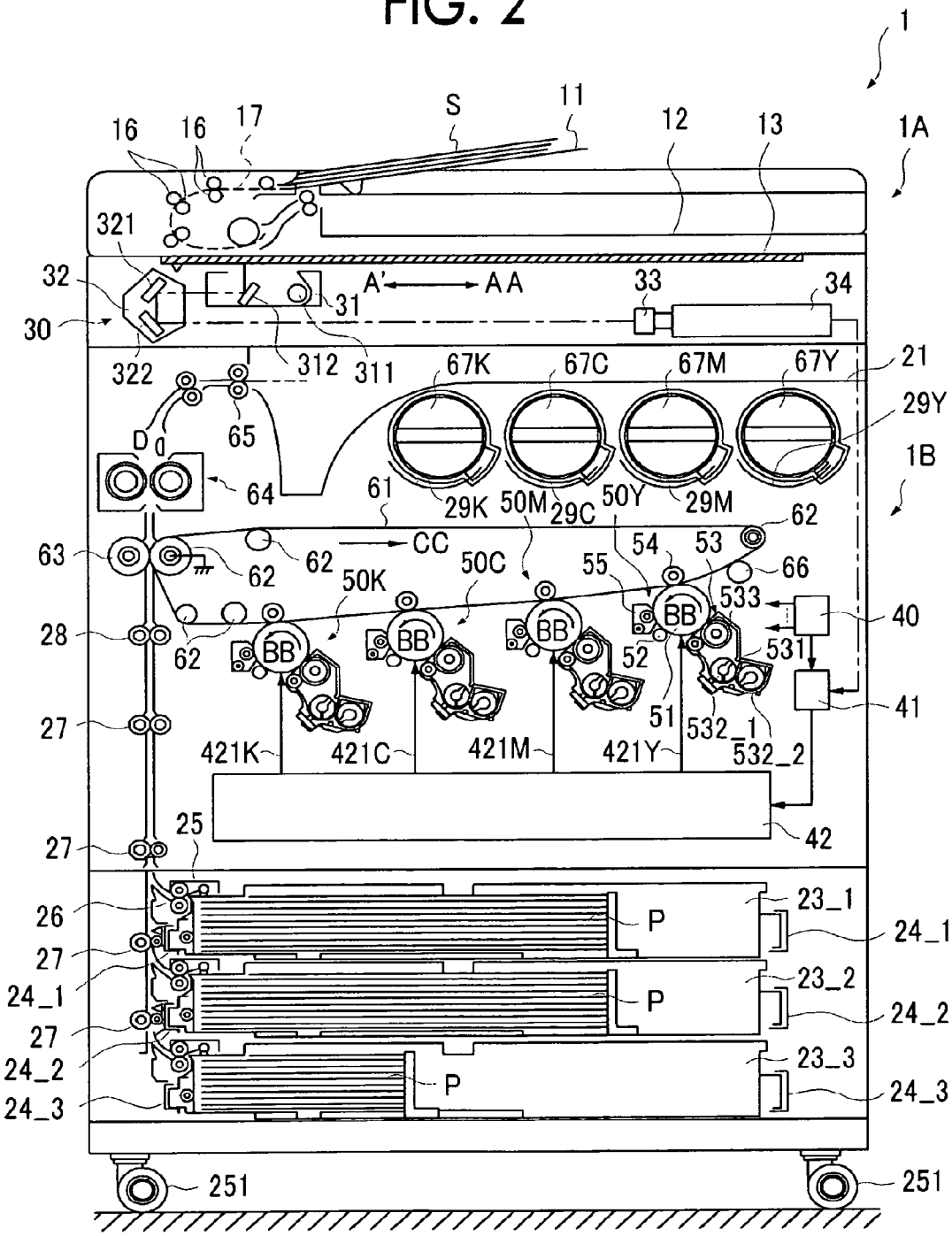
FIG. 2 is an internal configurational diagram of the copying machine of which the appearance is shown in FIG. 1.

FIG. 2 is an internal configurational diagram of the copying machine of which the appearance is shown in FIG. 1.

A document reading optical system 30 is provided below the document reading plate 13 made of transparent glass. The document reading optical system 30 includes a first block 31 that includes a lamp 311 and a mirror 312, a second block 32 that includes two mirrors 321 and 322, and a photoelectric sensor 33 that reads light representing an image and generates image signals.

The first and second blocks 31 and 32 are movable in the directions of arrows A and A' along the document reading plate 13, and are at left positions shown in FIG. 2 in an initial state.

Documents S placed on the document feed table 11 are fed one by one, and are transported onto a transporting path 17 facing the document reading plate 13 by transport rollers 16. When being transported while facing the document reading plate 13, the documents S are irradiated by the lamp 311. Light reflected from the documents S is reflected by the mirrors 312, 321, and 322 and read by the photoelectric sensor 33, and image signals representing letters or images recorded on the documents S are generated. The documents S, which are irradiated by the lamp 311, are further transported and fed onto the document discharge table 12.

When a document is placed on the document reading plate 13, the first and second blocks 31 and 32 move in the direction of the arrow AA so that an optical distance between the photoelectric sensor 33 and a document reading position on the document reading plate 13 is always maintained constant. Further, the lamp 311 irradiates the document in the meantime, and letters or images recorded on the document are read by the photoelectric sensor 33 and converted into image signals.

The image signals obtained by the photoelectric sensor 33 are input to an image processing unit 34. The image signals obtained by the photoelectric sensor 33 are image signals that represent colors, that is, R (red), G (green), and B (blue). The image processing unit 34 converts these RGB image signals to image data that are formed of Y (yellow), M (magenta), C (cyan), and K (black), and temporarily stores the image data. Moreover, the image data are sent to an exposure controller 41 in time for the exposure for forming a latent image to be described below.

The image forming section 1B is provided with an exposure unit 42. The image data corresponding to Y, M, C, and K are sent to the exposure unit 42 from the exposure controller 41 in accordance with the format of a latent image, and respective exposure lights 421Y, 421M, 421C, and 421K, which are modulated by the respective image data corresponding to Y, M, C, and K, are radiated from the exposure unit 42.

Further, in FIG. 2, a main controller 40 is shown at a position adjacent to the exposure controller 41. The main controller 40 is formed of a microcomputer and a program that is executed by the microcomputer. The main controller 40 is connected to the exposure controller 41, the display operation section 14 (see FIG. 1), the image processing unit 34, other various power circuits or drive circuits (not shown), and the like; and is in charge of the control of the entire copying machine 1.

The above-mentioned three sheet feed trays 231, 232, and 23_3 are supported by left and right guide rails 24_1, 24_2, and 24_3 and housed in the lower portion of the image forming section 1B. Sheets P are stored in each of the sheet feed trays 23_1, 23_2, and 23_3 while being stacked. Each of the sheet feed trays 231, 232, and 233 is adapted so as to be capable of being freely drawn while being guided by the guide rails 24_1, 24_2, and 24_3, for the purpose of the replenishment of sheets P.

Sheets P are fed from a sheet feed tray (here, for example, the sheet feed tray 23_1), which is designated by the operation or the like of the display operation section 14 (see FIG. 1), among these three sheet feed trays 23_1, 23_2 and 23_3 by a pickup roll 25 and are separated one by one by retard rolls 26. One separated sheet P is transported upward by transport rolls 27. Then, the transport timing of the sheet after standby rolls 28 is adjusted by the standby rolls 28, and the sheet is further transported upward. The transport of a sheet after the standby rolls 28 will be described below.

Four image forming units 50Y, 50M, 50C, and 50K, which form toner images by the toners corresponding to the respective colors, that is, Y, M, C, and K, are disposed in the middle portion of the image forming section 1B. Since these four image forming units 50Y, 50M, 50C, and 50K have the same configuration except that colors of toners in use are different from each other, the image forming unit 50Y is selected here and the configuration of the image forming unit 50Y will be described.

The image forming unit 50Y includes a photoreceptor 51 that rotates in the direction indicated in FIG. 2 by an arrow BB. A charger 52, a developer unit 53, and a cleaner 55 are disposed around the photoreceptor 51. Further, a transfer unit 54 is disposed at a position where an intermediate transfer belt 61 to be described below is interposed between the photoreceptor 51 and the transfer unit 54.

The photoreceptor 51 has the shape of a roll, retains electrical charges by charging, discharges the electrical charges by exposure, and holds an electrostatic latent image on the surface thereof.

The charger 52 charges the surface of the photoreceptor 51 to a certain charged potential.

Moreover, the image forming section 1B includes the above-mentioned exposure unit 42. Image signals are input to the exposure unit 42 from the exposure controller 41, and the exposure unit 42 outputs the exposure lights 421Y, 421M, 421C, and 421K that are modulated according to the input image signal. After being charged by the charger 52, the photoreceptor 51 is irradiated with the exposure light 421Y output from the exposure unit 42. Accordingly, an electrostatic latent image is formed on the surface of the photoreceptor 51.

After the photoreceptor 51 is irradiated with the exposure light 421Y and the electrostatic latent image is formed on the surface of the photoreceptor 51, the electrostatic latent image is developed by the developer unit 53. Accordingly, a toner image (a toner image formed using a yellow (Y) toner in the image forming unit 50Y) is formed on the surface of the photoreceptor 51.

The developer unit 53 includes two augers 532_1 and 532_2 and a developing roller 533 that are disposed in a case 531 in which a developer formed of a toner and a carrier is stored. The two augers 532_1 and 532_2 agitate the developer, and the developing roller 533 carries the developer to a position facing the photoreceptor 51. When the electrostatic latent image formed on the photoreceptor 51 is developed, a bias voltage is applied to the developing roller 533 and the toner contained in the developer is attached to the photoreceptor 51 along the electrostatic latent image, which is formed on the photoreceptor 51, by the action of the bias voltage. Accordingly, a toner image is formed.

The toner image, which is formed on the photoreceptor 51 through the development performed by the developer unit 53, is transferred to the intermediate transfer belt 61 by the action of the transfer unit 54.

A toner, which remains on the photoreceptor 51 after this transfer, is removed from the photoreceptor 51 by the cleaner 55.

The intermediate transfer belt 61 is an endless belt that is wound around plural rolls 62 and rotated in the direction of an arrow CC.

The toner images, which are formed using the respective color toners by the respective image forming units 50Y, 50M, 500, and 50K, are transferred to the intermediate transfer belt 61 so as to be sequentially stacked, and are transported to a secondary transfer position where a transfer unit 63 is disposed. A sheet, which has been transported to the standby rolls 28, is transported to the secondary transfer position in synchronization with this and the toner images transferred to the intermediate transfer belt 61 are transferred to the transported sheet by the action of the transfer unit 63. The sheet to which the toner images have been transferred is further transported, and the toner images transferred to the sheet are fixed to the sheet by being pressed and heated by the fixing unit 64. Accordingly, an image formed of the fixed toner images is formed on the sheet. The sheet on which the image has been formed is further transported, and is discharged onto the sheet discharge table 21 by discharge rollers 65.

The intermediate transfer belt 61 from which the toner images have been transferred to the sheet by the transfer unit 63 is further rotated, and a toner remaining on the surface of the intermediate transfer belt is removed from the intermediate transfer belt 61 by a cleaner 66.

Further, container mounting portions 29Y, 29M, 29C, and 29K are provided above the intermediate transfer belt 61 in the image forming section 1B. Toner containers 67Y, 67M, 67C, and 67K, which store the respective color toners corresponding to yellow (Y), magenta (M), cyan (C), and black (K), are mounted on these container mounting portions 29Y, 29M, 29C, and 29K, respectively. The respective color toners, which are stored in these toner containers 67Y, 67M, 67C, and 67K, are replenished to the respective developer units 53 according to the consumption of the toners in the corresponding developer units 53.

Moreover, in the image forming section 1B, "process control" is performed with various events, such as the formation of a predetermined number of images or the change of temperature and humidity environment and the replacement of a part. In this process control, uniform images having predetermined image densities (toner patches) are formed, the densities of the toner patches are measured by a detector (not shown) and compared with a reference density, and various elements are adjusted so that the density of the patch becomes a reference. The various elements include, for example, the conversion of the image density of image data, the amount of toner replenished to the developer unit from the toner container, the amount charged by the charger, the amount of exposure light radiated by the exposure unit, the developing bias voltage of the developer unit, and the like. The temporal change of image density is corrected by this process control, so that an image having constant density is formed. When an event where process control should be performed comes, process control cannot be immediately performed since a printing operation or the like is being performed at this point of time. Accordingly, a process control execution request flag is raised and the flag is referred at a timing where process control can be performed, and the process control is performed if the flag is raised.

Figure 3:
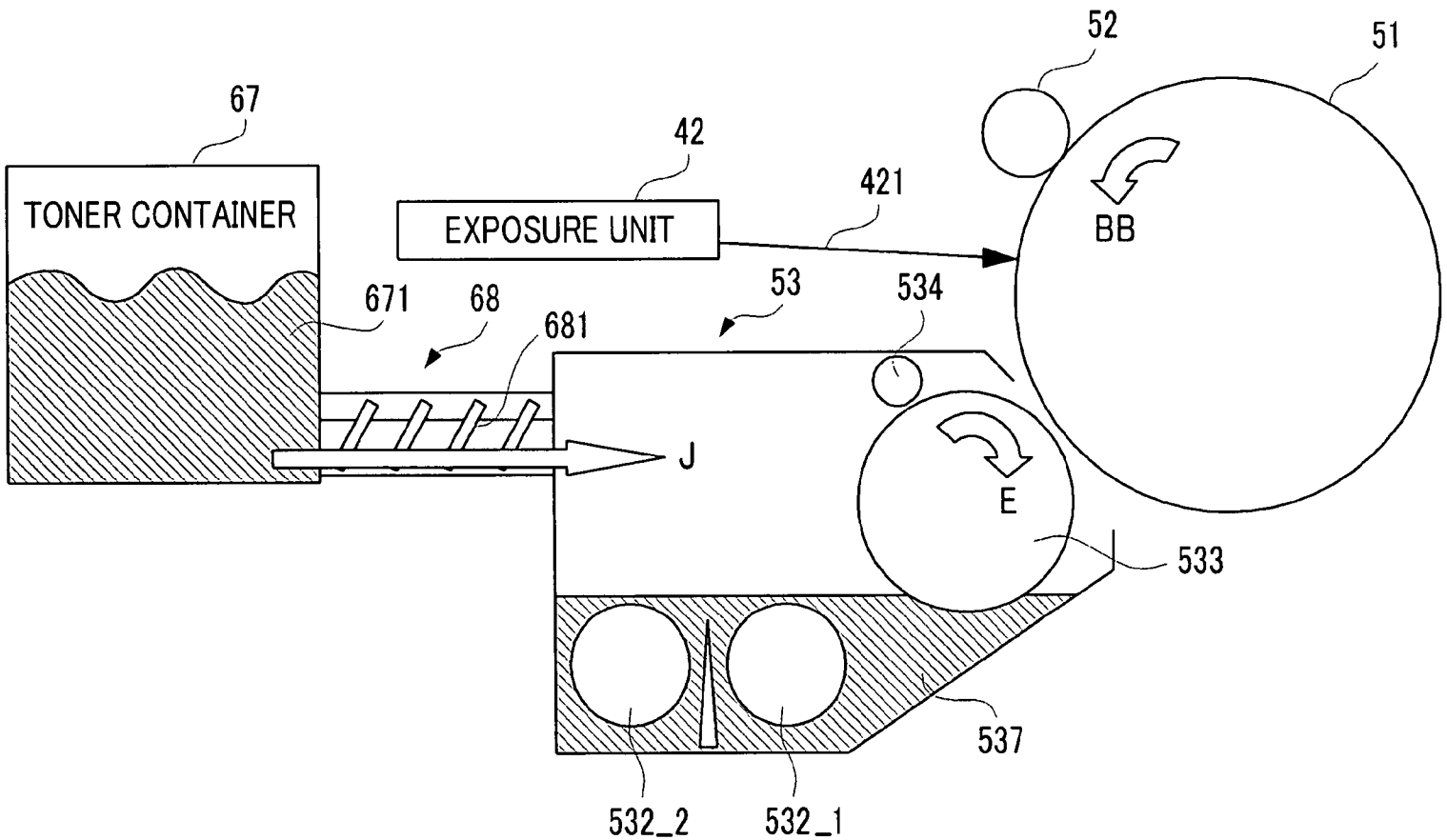
FIG. 3 is a schematic cross-sectional view showing a toner container and a developer unit.
Figure 4:
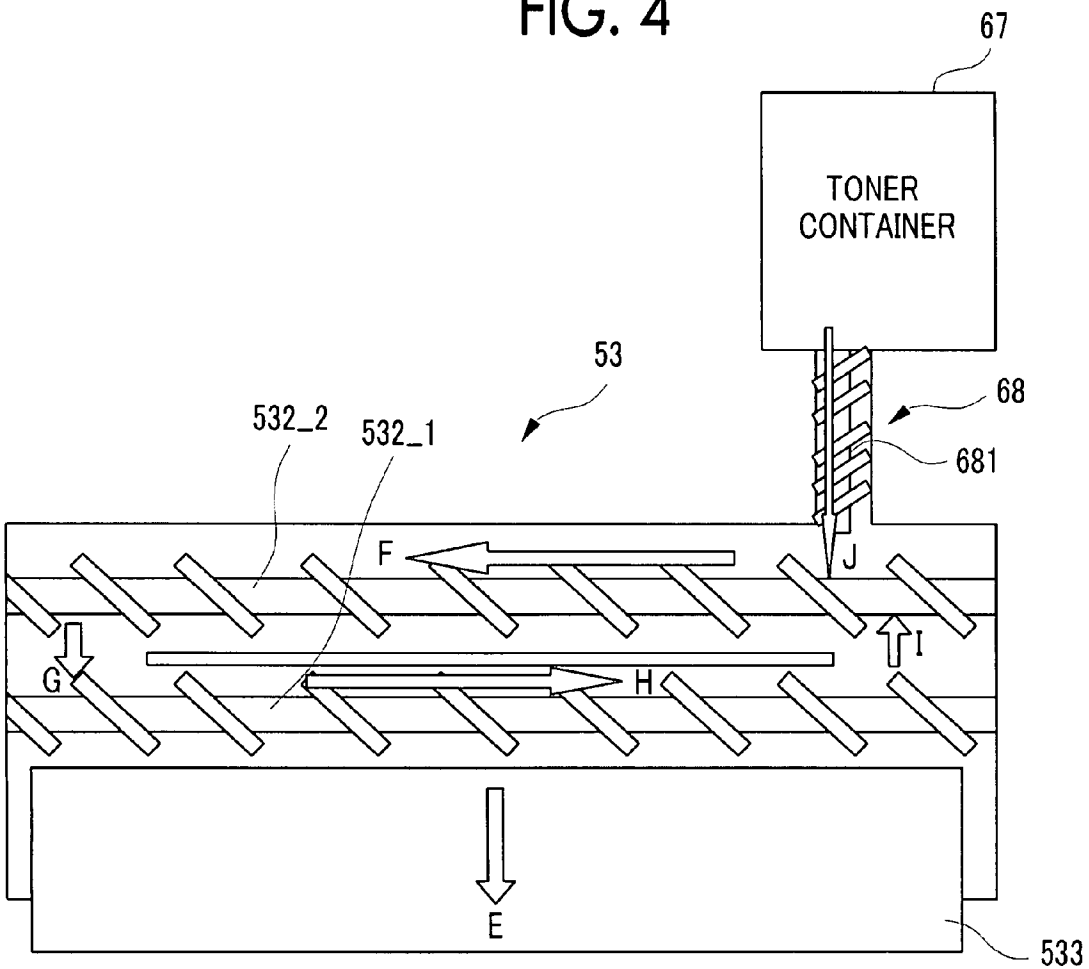
FIG. 4 is a schematic cross-sectional view showing the toner container and the developer unit.

FIGS. 3 and 4 are schematic cross-sectional views showing the toner container and the developer unit. Here, FIG. 3 is a schematic cross-sectional view when seen from the side, and FIG. 4 is a schematic cross-sectional view when seen from above.

Here, only one system is typically shown and the respective components are denoted by reference numerals of which Y, M, C, and K are omitted.

A developer 537 (see FIG. 3), which includes a toner and a carrier, is stored in the developer unit 53 and is agitated by two augers 532_1 and 532_2 so as to circulate in the direction indicated by arrows F, G, H, and I shown in FIG. 4. The developer 537 is held by the developing roller 533 rotating in the direction indicated by an arrow E, is subjected to layer thickness regulation performed by a layer thickness regulating member 534, and is transported to a development position facing the photoreceptor 51. Meanwhile, the photoreceptor 51 rotates in the direction indicated by an arrow BB, is charged by the charger 52, and is irradiated with exposure light radiated from the exposure unit 42, so that an electrostatic latent image is formed. The electrostatic latent image is developed by the toner contained in the developer that is transported by the developing roller 533. Accordingly, a toner image is formed on the photoreceptor 51. Since the subsequent process of the toner image formed on the photoreceptor 51 has been described with reference to FIG. 2, the repeated description thereof will be omitted here.

When the toner contained in the developer 537 stored in the developer unit 53 is consumed in this way, the toner contained in the developer 537 falls short. Then, an auger 681 provided in a toner replenishing passage 68 rotates, so that a replenishing toner 671 stored in the toner container 67 is transported in the toner replenishing passage 68 in the direction indicated by an arrow J and is supplied to the developer unit 53. While being transported so as to circulate along the arrows F, G, H, and J shown in FIG. 4, the toner supplied to the developer unit 53 is agitated by the two augers 532_1 and 532_2 and mixed with the carrier.

Figure 5:
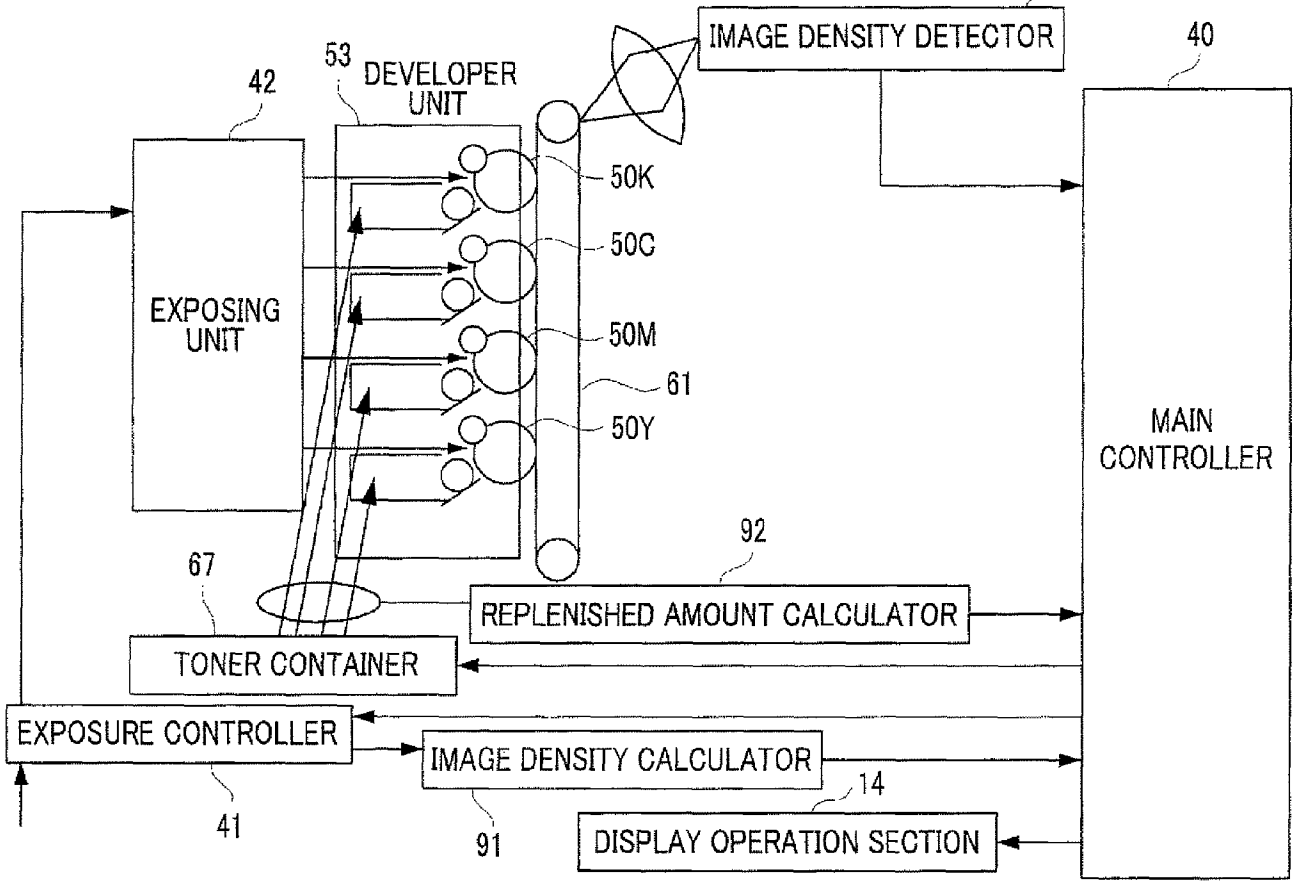
FIG. 5 is a block diagram showing a control system of this exemplary embodiment.

FIG. 5 is a block diagram showing a control system of this exemplary embodiment. FIG. 5 shows only elements required for illustrating the characteristic portions of this exemplary embodiment.

The main controller 40, the display operation section 14, the exposure controller 41, the exposure unit 42, the developer unit 53, the toner container 67, the photoreceptors SOY, 50M, 50C, and 50K, and intermediate transfer belt 61, which are also shown in FIG. 1 or 2, are shown in FIG. 5. However, in FIG. 5, developer units 53 are shown as the four developer units shown in FIG. 2 and toner containers 67 are shown as the four toner containers shown in FIG. 2. Since these respective elements shown in FIG. 1 or 2 have been described except for matters concerning the communication between the toner container 67 and the main controller 40, the repeated description thereof will be omitted and only the matters concerning the communication will be described.

Nonvolatile memories (not shown) corresponding to the toner containers 67Y, 67M, 67C, and 67K (see FIG. 2) corresponding to the respective colors, that is, Y, M, C, and K are mounted on the toner containers 67. The main controller 40 communicates with the nonvolatile memories mounted on these respective toner containers 67, and reads out the types, past use history, or the like of the toner containers from the nonvolatile memories or writes new use history or the like.

An image density calculator 91, a replenished amount calculator 92, and an image density detector 93 are further shown in FIG. 5.

In the image density calculator 91, image density is calculated for each of the colors, that is, Y, M, C, and K on the basis of the image data sent to the exposure controller 41 from the image processing unit 34 shown in FIG. 2. That is, in the image forming section 1B shown in FIGS. 1 and 2, the images representing the shading of images are formed by the densities of pixels to which toners are attached. In the image density calculator 91, the number of pixels, to which the toners are attached, for each of the images and the colors, that is, Y, M, C, and K is calculated on the basis of the image data. The information about the calculated number of pixels is sent to the main controller 40, and the cumulative number of pixels, which is a value of the cumulative number of pixels of images formed until now, is calculated for each of the colors, that is, Y, M, C, and K in the main controller 40.

Further, the amount of toner replenished to the developer unit 53 from the toner container 67 is calculated in the replenished amount calculator 92. However, since the amount of replenished toner is calculated on the basis of the number of rotations of the auger 681 provided in the toner replenishing passage 68 shown in FIGS. 3 and 4, the amount of replenished toner may be different from the actual amount of replenished toner. For example, the actual amount of replenished toner fluctuates due to environmental temperature and humidity, and the actual amount of replenished toner fluctuates even when the toner container 67 is filled with a replenishing toner and is substantially empty. The information about the amount of replenished toner, which is calculated in the replenished amount calculator 92, is transmitted to the main controller 40, and a calculated value of the cumulative amount of replenished toner, which is a value of the cumulative amount of replenished toner, is calculated in the main controller 40. Here, the calculation of the amount of replenished toner, which is to be performed in the replenished amount calculator 92, is also performed for each of the respective color toners corresponding to Y, M, C, and K like the calculation of the number of pixels that is performed in the image density calculator 91. Accordingly, a calculated value of the cumulative amount of replenished toner, which corresponds to each of the color toners, is calculated in the main controller 40.

Furthermore, the densities of the respective toner patches, which are formed in the above-mentioned process control by the respective color toners corresponding to Y, M, C, and K, are detected in the image density detector 93. The detection results of the densities of these toner patches are also transmitted to the main controller 40.

A toner remaining amount calculating process for calculating the amount of toner remaining in the toner container, which is to be performed in the main controller 40, will be described with reference to the above-mentioned configuration.

Figure 6:
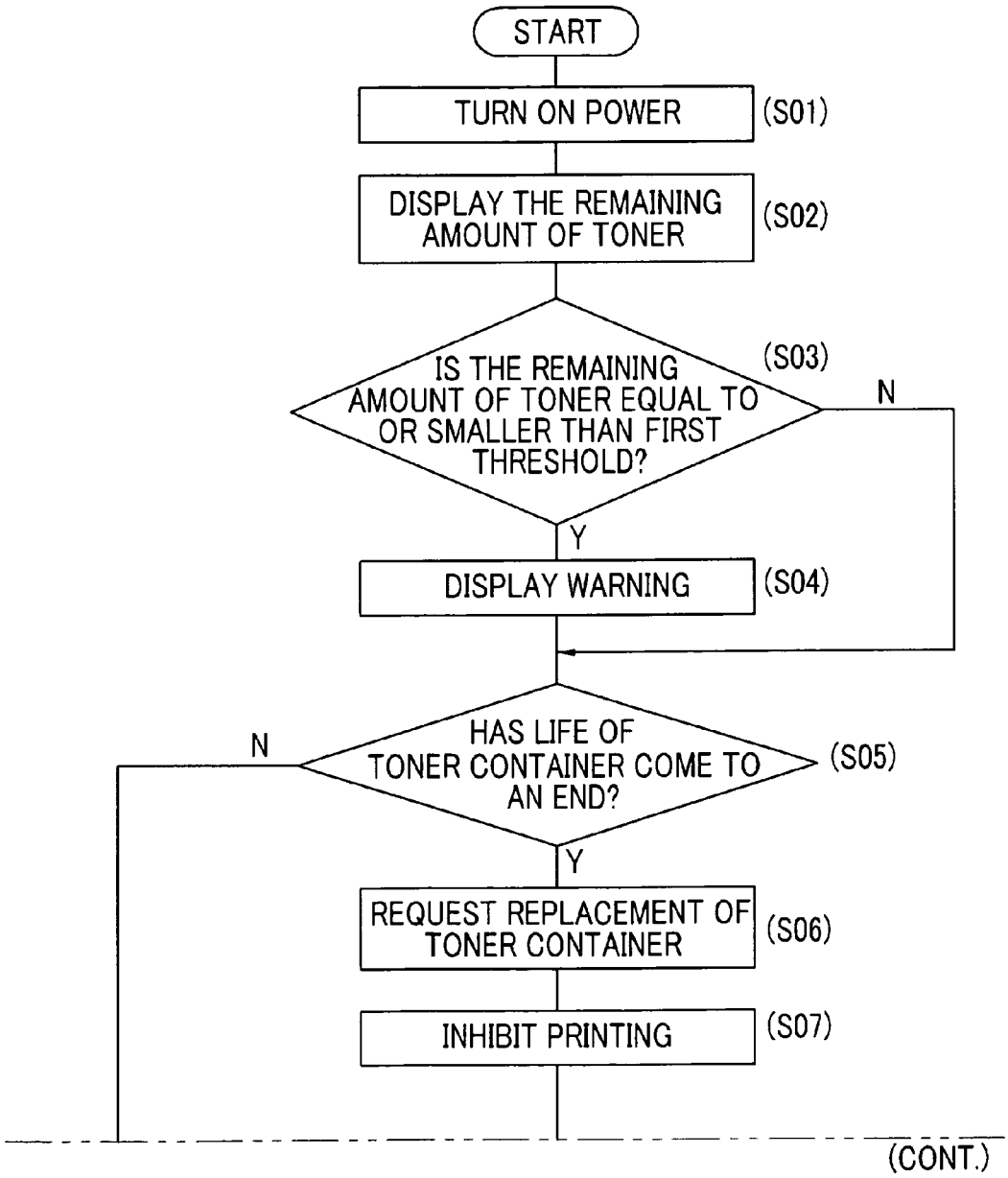
FIG. 6 is a flowchart illustrating a process for calculating the remaining amount of toner that is performed by a main controller when power is supplied to the copying machine shown in FIG. 1.

FIG. 6 is a flowchart illustrating a process for calculating the remaining amount of toner that is performed by the main controller when power is supplied to the copying machine shown in FIG. 1.

When power is supplied to the copying machine 1 shown in FIGS. 1 and 2 (Step S01), the amount of toner remaining in the toner container is displayed on the display operation section 14 shown in FIG. 1 (Step S02). The remaining amount of toner, which is displayed here, is the remaining amount of toner that is calculated in Step S23 or S24 shown in FIG. 7, updated according to need (Step S26), and displayed when power has been turned off last time. A method of calculating the remaining amount of toner will be described below. However, when a new toner container is not used yet after being mounted, the remaining amount of toner is displayed as 100%.

Then, it is determined whether the remaining amount of toner is equal to or smaller than a first threshold (Step S03). If it is determined that the remaining amount of toner is equal to or smaller than the first threshold, a warning is displayed in addition to the remaining amount of toner of Step S02 (Step S04). Here, the first threshold corresponds to an example of a second threshold of the invention, and is a threshold used to determine that the amount of toner remaining in the toner container is reduced to, for example, 25%.

Moreover, it is determined in Step S05 whether the life of the toner container has come to an end, that is, whether the amount of toner remaining in the toner container is 0%.

If it is determined that the life of the toner container has come to an end, a replacement request message is displayed so that the toner container is replaced with a new toner container (Step S06) and a printing operation is temporarily inhibited (Step S07). When the toner container is replaced, a process (not shown) for resuming a printing operation is performed and a printing operation is allowed again.

Meanwhile, as shown in FIG. 2, four toner containers 67Y, 67M, 67C, and 67K are mounted on the copying machine 1. Accordingly, a process or a display is performed for each of the toner containers in Steps S02 to S04 and Step S06. However, in Step S05, it is determined that the life of the toner container has come to an end even if the life of any one toner container of the four toner containers has come to an end. Then, the process proceeds to Step S06. In Step S07, a printing operation is inhibited even if the life of any one toner container has come to an end.

If it is determined in Step S05 that the lives of all the four toner containers have not yet come to an end, the process proceeds to Step S11 and it is determined whether a process control execution request flag is raised. If a process control execution request flag is not raised, a process at the time of power-on shown in FIG. 6 is ended.

If it is determined in Step S11 that a process control execution request flag is raised, process control is performed (Step S12). Further, the density of a toner patch formed in the process control is detected in the image density detector 93 shown in FIG. 5, and it is determined whether the density of the toner patch is lower than a second threshold (Step S06). The second threshold is a threshold used to determine that the concentration of a toner of a developer stored in the developer unit (a ratio of a toner to a carrier) is excessively reduced and thus should be recovered. If it is determined in Step S13 that the concentration of a toner is not lower than the second threshold, the process shown in FIG. 6 is ended. The process control itself is simultaneously performed for the respective colors, that is, Y, M, C, and K. However, a process, such as, the determination of whether the concentration of a toner is lower than the second threshold (Step S13) or the subsequent recovery replenishment (Step S14) to be described below, are performed for the respective developer units or toner containers corresponding to the respective color toners corresponding to Y, M, C, and K.

Meanwhile, if it is determined in Step S13 that the concentration of a toner is lower than the second threshold, the process proceeds to Step S14 and recovery replenishment is performed. That is, here, a replenishing operation for replenishing a toner to the developer unit from the toner container is performed to recover the concentration of a toner of a developer stored in the developer unit. Specifically, a process for rotating the auger 681 provided in the toner replenishing passage 68 shown in FIGS. 3 and 4 is performed here. After that, process control is performed again (Step S15) and it is determined whether the concentration of a toner is recovered (Step S16). If the concentration of a toner is recovered, the process shown in FIG. 6 is ended. Meanwhile, a toner replenishing operation is not performed only when process control is performed. That is, the amount of toner used is estimated from the amount of a usually used toner and a toner is also replenished by the amount of toner corresponding to the estimated amount of toner used. If the concentration of a toner is still lower than the second threshold (Step S13), recovery replenishment (Step S14) is performed. The recovery replenishment is performed in a normal operating range as described above, but is performed in the following states in terms of the amount of toner remaining in the toner container that is of interest in this exemplary embodiment. That is, for example, a process subsequent to Step S14 is performed when the toner container on which the nonvolatile memory is mounted is empty due to a certain reason even though it is determined that the life of the toner container has not yet come to an end from the data of the nonvolatile memory mounted on the toner container. That is, the process subsequent to Step S14 is a process for securing safety when any abnormality occurs in terms of the life of the toner container.

If it is determined in Step S16 that the concentration of a toner is not recovered (which means that the remaining amount of toner is actually 0% although it is determined that the life of the mounted toner container has not yet come to an end as described above), a replacement request message for the toner container is displayed on the display operation section 14 (see FIGS. 1 and 5) (Step S17).

After that, if a new toner container is mounted (Step S18), the recovery replenishment is performed again (Step S14). The communication with a nonvolatile memory mounted on a toner container, of which reliable mounting is determined with the detection of, for example, an operation for opening/closing the front cover 22 shown in FIG. 1, is tried and it is determined that the toner container is mounted if the communication with the nonvolatile memory can be performed.

Figure 7:
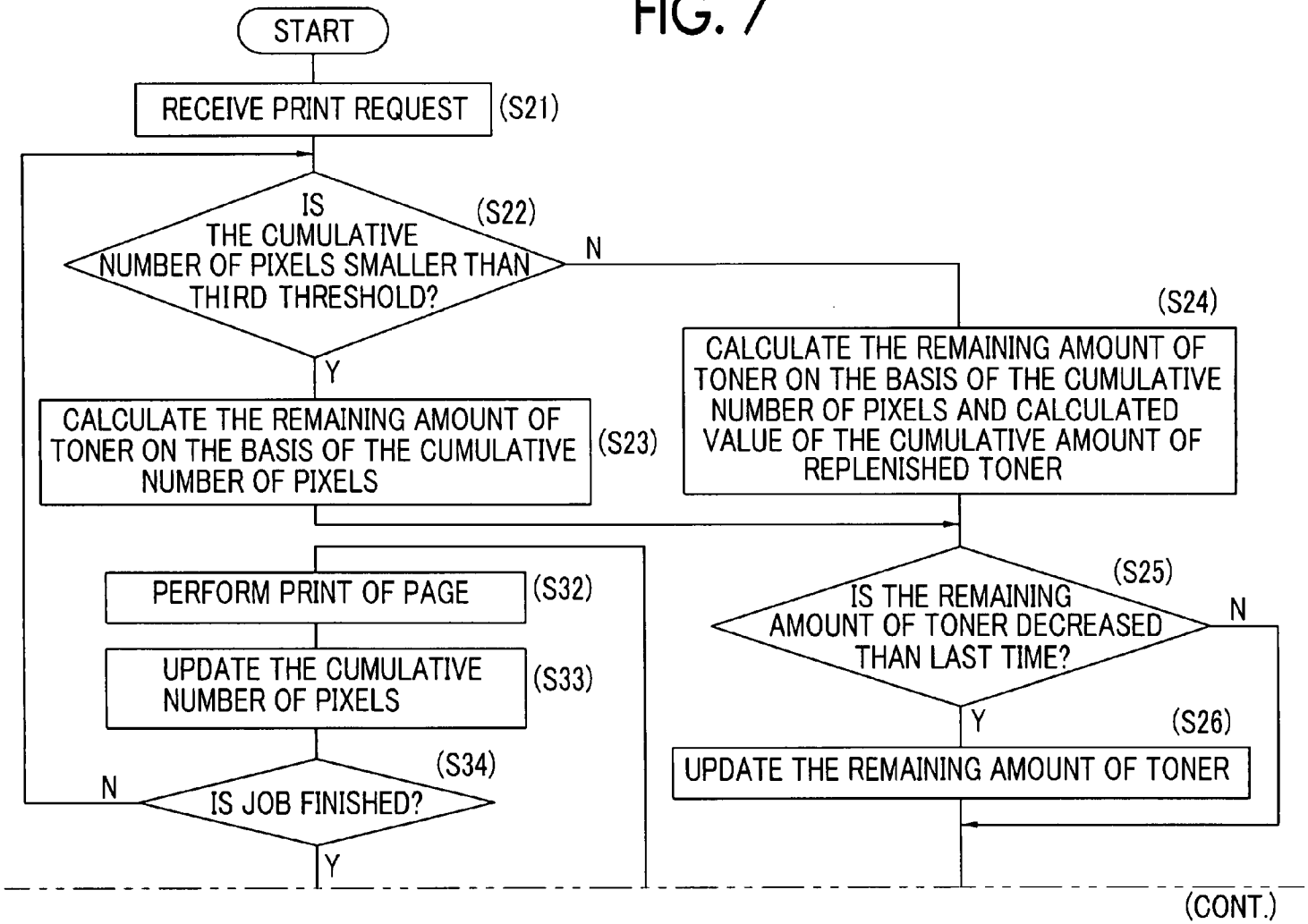
FIG. 7 is a flowchart illustrating a process for calculating the remaining amount of toner that is performed when there is a print request.

FIG. 7 is a flowchart illustrating a process for calculating the remaining amount of toner that is performed when there is a print request. Except for the execution of page print (Step S32), the execution of process control (Steps S36 and S39), and the inhibition of print (Step S31), a process shown in FIG. 7 is also performed for the respective developer units or toner containers corresponding to the respective color toners corresponding to Y, M, C, and K.

If the image forming section 1B shown in FIGS. 1 and 2 receives a print request (Step S21), it is determined first whether the cumulative number of pixels after the mounting of a new toner container is smaller than a third threshold (Step S22).

The third threshold corresponds to an example of a first threshold of the invention, and is a threshold used to determine whether a stage is in an early stage where a new toner container is mounted and has just started to be used. A value, which is obtained by converting the cumulative number of pixels into the remaining amount of toner and corresponds to, for example, 90% of the remaining amount of toner, is employed as the third threshold.

Here, in FIG. 8 to be described below, a value exceeding 100% from 0% is shown as the cumulative number of pixels and a value exceeding 100% from 0% is shown as a calculated value of the cumulative amount of replenished toner. 0% of the cumulative number of pixels and 0% of a calculated value of the cumulative amount of replenished toner among these values mean a state where the amount of toner remaining in a toner container immediately after the mounting of a new toner container is 100%. Further, 100% of the cumulative number of pixels and 100% of a calculated value of the cumulative amount of replenished toner are the cumulative number of pixels and a calculated value of the cumulative amount of replenished toner that can be regarded as the life of a toner container when an image having normal image density continues to be printed under a normal operating environment. However, actually, the operating environment is also variously changed, so that the image density of an image to be printed is also variously changed. Accordingly, the life of a toner container may be lower than 100%, and may not come to an end yet even though exceeding 100%.

Figure 8:
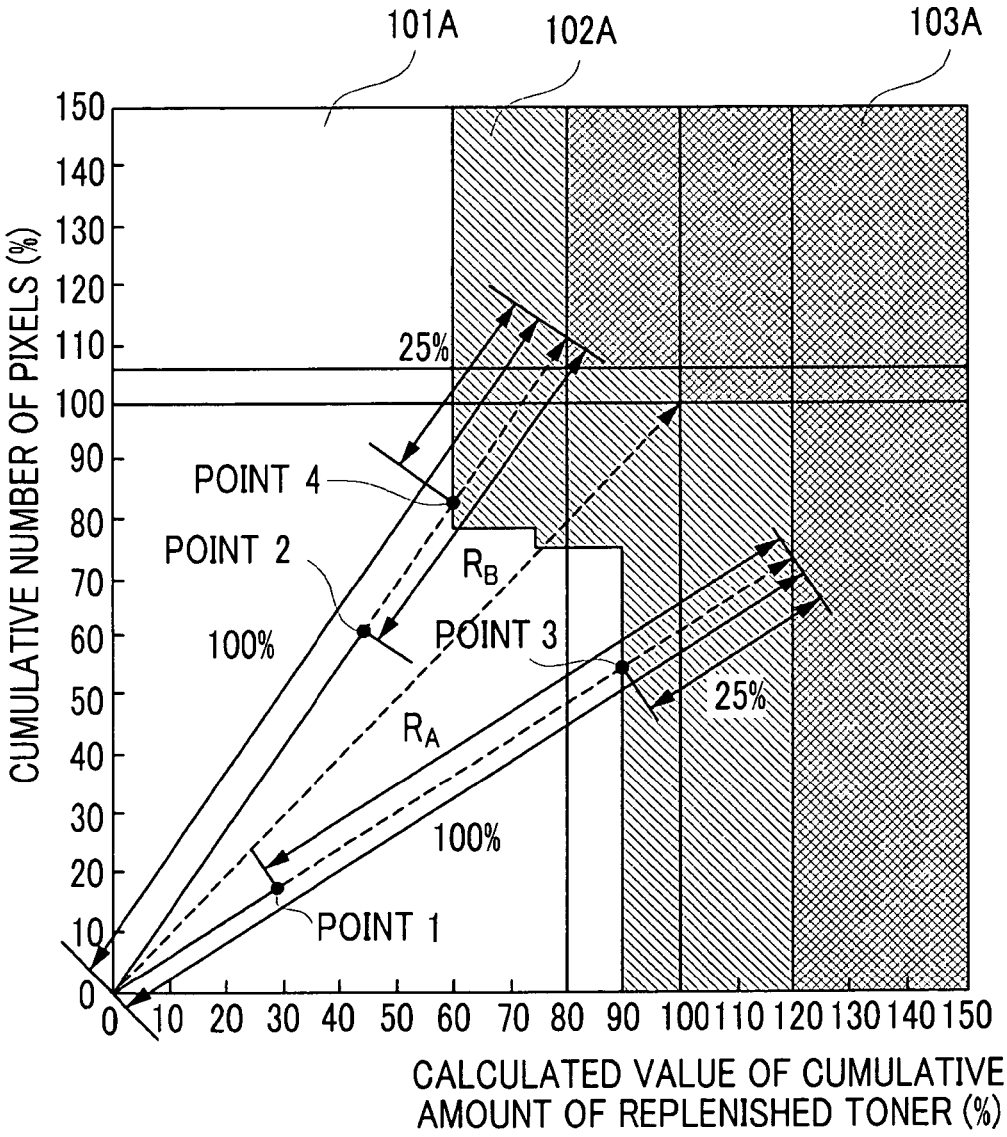
FIG. 8 is a view illustrating an algorithm of this exemplary embodiment that calculates the remaining amount of toner.

The description of FIG. 8 is completed here, and description will be continued returning to FIG. 7.

If it is determined in Step S22 that the cumulative number of pixels is smaller than the third threshold a process proceeds to Step S23 and the remaining amount of toner is calculated on the basis of the cumulative number of pixels. Meanwhile, if it is determined in Step S22 that the cumulative number of pixels is equal to or larger than the third threshold, the process proceeds to Step S24 and the remaining amount of toner is calculated on the basis of both the cumulative number of pixels and a calculated value of the cumulative amount of replenished toner.

A case where a toner is not replenished even though the cumulative number of pixels is increased or a case where a large amount of toner is replenished even though the cumulative number of pixels is almost not increased in contrast to this case is generated due to the false detection, the variation of detection, or the like of the concentration of a toner of a developer stored in the developer unit, in an early stage where the cumulative number of pixels is smaller than the third threshold and a new toner container just starts to be used. Accordingly, in this exemplary embodiment, the remaining amount of toner is calculated on the basis of the cumulative number of pixels that is relatively stable (Step S23) if the cumulative number of pixels is smaller than the third threshold. A specific algorithm for calculating the remaining amount of toner in Steps S23 and S24 will be described later with reference to FIG. 8. Here, the description of the flowchart of FIG. 7 will be made first.

When the amount of toner remaining in the toner container is calculated in Steps S23 and S24, it is determined whether the remaining amount of toner as the calculation result is decreased as compared to the remaining amount of toner calculated last time (Step S25). Only if the remaining amount of toner is decreased compared with the last time, the remaining amount of toner is updated and the updated remaining amount of toner is reflected on the display of the display operation section 14 (Step S26). Accordingly, an uncomfortable feeling in which a remaining amount of toner decreased once on display is increased during the process is excluded.

Since the process of the subsequent Steps S27 to S31 is the same as that of Steps S03 to S07 of the flowchart shown in FIG. 6, the description thereof will be omitted.

If it is determined in Step S29 that the life of any one of the four toner containers 67Y, 67M, 67C, and 67K (see FIG. 2) has not yet come to an end, the print corresponding to one page is performed (Step S32) and the cumulative number of pixels is further updated by as many as one page (Step S33).

Meanwhile, separately from the process of which the flowchart is shown in FIG. 7, a calculated value of the cumulative amount of replenished toner is updated whenever a toner replenishing operation is performed.

Moreover, it is determined whether a job formed of the print corresponding to one or plural pages, which are printed by a single print request and includes one page printed this time, is finished (Step S34). If the job is not finished yet, the process subsequent to Step S22 is repeated. If it is determined in Step S34 that the job is finished, the process proceeds to the process subsequent to Step S35. Since the process of Steps S35 to S42 is the same as that of Steps S11 to S18 of the flowchart shown in FIG. 6, the repeated description will be omitted.

Next, an algorithm for calculating the amount of toner remaining in the toner container, which is executed in Steps S23 and S24 of FIG. 7, will be described.

FIG. 8 is a view illustrating the algorithm of this exemplary embodiment that calculates the remaining amount of toner.

Here, a remaining amount space, which represents the remaining amount of toner and is a two-dimensional space where a horizontal axis represents a calculated value (%) of the cumulative amount of replenished toner and a vertical axis represents the cumulative number (%) of pixels, is shown. An empty area (area 103A) of the remaining amount space is previously defined and stored in a storage unit provided in the main controller 40 (see FIGS. 1 and 5).

In this exemplary embodiment, the empty area of the remaining amount space has been stored in the storage unit provided in the main controller 40. However, the invention is not limited to this exemplary embodiment. A storage unit may be provided outside the main controller and the empty area of the remaining amount space may be stored in the storage unit.

Each of the calculated value (%) of the cumulative amount of replenished toner and the cumulative number (%) of pixels corresponds to an example of each of primary remaining amounts of the invention. The meaning of % is the same as described above. Further, in FIG. 8, an area 101A, which is not hatched or shaded, is an area where there is the sufficient remaining amount of toner, a hatched area 102A is an area where the remaining amount of toner is equal to or lower than 25%, and a shaded area 103A is an empty area where the life of a toner container has come to an end and the remaining amount of toner is 0%.

First, an algorithm, which calculates the remaining amount of toner on the basis of both the calculated value of the cumulative amount of replenished toner and the cumulative number of pixels in Step S24 of FIG. 7, will be described here.

In Step S24, a ratio R of a distance between the current coordinates (x %, y %) and the empty area (area 103A) to a distance between the origin and the empty area (area 103A) on a straight line, which passes through the origin (0%, 0%) where a toner container is not in use and the current coordinates (x %, y %) defined by the calculated cumulative number of pixels and a calculated value of the cumulative amount of replenished toner in the remaining amount space shown in FIG. 8, is calculated as the current remaining amount of toner.

That is, when the coordinates of a point where the straight line reaches the empty area (area 103A) is defined by ($x_0$%, $y_0$%), the ratio R is calculated by Expression (1).

[Expression 1]

$$R = \sqrt{\frac{(x_0 - x)^2 + (y_0 - y)^2}{x_0^2 + y_0^2}} \times 100(\%) \tag{1}$$

That is, when the current coordinates are a point_A shown in FIG. 8, a ratio $R_A$ of a distance between the point_A and a point where the straight line reaches the empty area (area 103A) to a distance between the origin (0, 0) and a point where the straight line connecting the origin (0, 0) with the point_A reaches the empty area (area 103A) is calculated on the basis of Expression (1). The ratio $R_A$ becomes the current remaining amount of toner.

Further, similar to this, when the current coordinates are a point_B shown in FIG. 8, a ratio $R_B$ of a distance between the point_B and a point where the straight line reaches the empty area (area 103A) to a distance between the origin (0, 0) and a point where the straight line connecting the origin (0, 0) with the point_B reaches the empty area (area 103A) is calculated on the basis of Expression (1). The ratio $R_B$ becomes the current remaining amount of toner.

When the current point currently positioned at the point_A moves on the straight line connecting the origin with the point_A as it is and reaches a point_C that is the boundary between the areas 101A and 102A, a warning meaning that the remaining amount of toner at that point of time is small is displayed (Step S28 of FIG. 7). The point_C is a point where the remaining amount of toner is decreased to 25%.

Further, similar to this, when the current point currently positioned at the point_B moves on the straight line connecting the origin with the point_B as it is and reaches a point_D that is the boundary between the areas 101A and 102A, a warning meaning that the remaining amount of toner at that point of time is small is displayed. The point_D is also a point where the remaining amount of toner is decreased to 25%.

Meanwhile, the invention is not limited to the fact that the current point (coordinate) moves along one straight line, and the current point may approach the empty area (area 103A) along a line meandering in various patterns according to the operating environment or the like case by case. The remaining amount of toner is calculated by applying the current point (coordinate), which corresponds to that point of time, to Expression (1).

According to the algorithm for calculating the remaining amount of toner described with reference to FIG. 8, the remaining amount of toner is calculated without uncomfortable feeling.

Next, an algorithm, which calculates the remaining amount of toner based on only the cumulative number of pixels in Step S23 of FIG. 7, will be described.

Here, while the cumulative number of pixels is referred and a calculated value of the cumulative amount of replenished toner is regarded as the same percentage as the cumulative number of pixels, the remaining amount of toner is calculated. That is, for example, a calculated value of the cumulative amount of replenished toner is also regarded as 5% when the cumulative number of pixels is 5%, and a calculated value of the cumulative amount of replenished toner is also regarded as 10% when the cumulative number of pixels is 10%. In other words, this means that it is regarded that the current point moves along a straight line inclined by an angle of 45° and shown in FIG. 8. Here, while it is regarded as described above, a ratio R based on the above-mentioned Expression (1) is calculated. The ratio R is regarded as the remaining amount of toner. The reason to calculate the remaining amount of toner on the basis of only the cumulative number of pixels is that there is a possibility that the amount of replenished toner in an early stage significantly varies as described above.

Next, various comparative examples of the algorithm for calculating the remaining amount of toner will be described.

Figure 9:
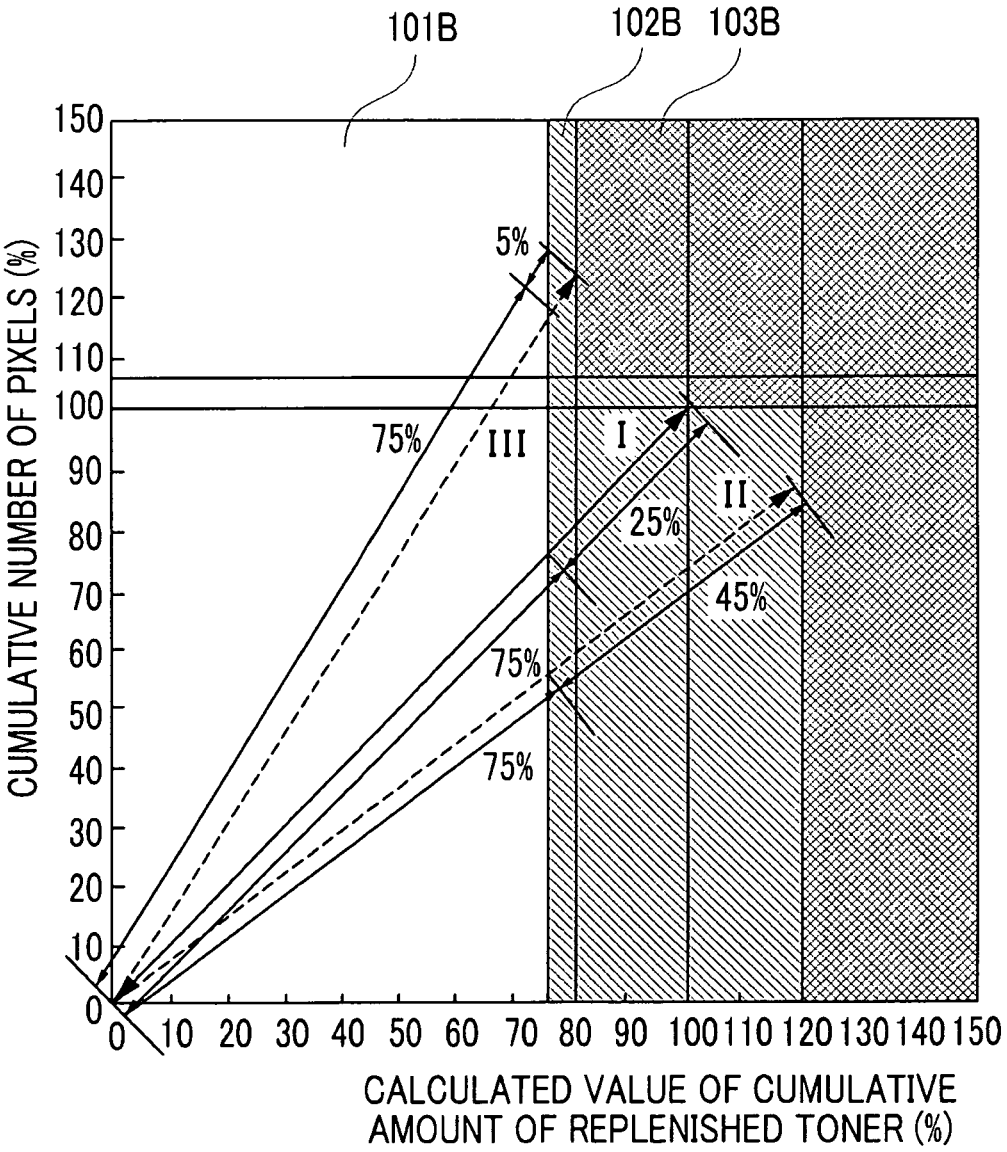
FIG. 9 is a view showing a remaining amount space when the remaining amount of toner is calculated on the basis of only a calculated value of the cumulative amount of replenished toner.

FIG. 9 is a view showing a remaining amount space when the remaining amount of toner is calculated on the basis of only a calculated value of the cumulative amount of replenished toner.

Areas 101B, 102B, and 103E correspond to the areas 101A, 102A, and 103A shown in FIG. 8, respectively. The area 103B is an empty area where the remaining amount of toner is defined as 0%, and the area 103B has the extent that is equal to the extent of the empty area 103A shown in FIG. 8. In contrast to this, here, the remaining amount of toner is calculated on the basis of only a calculated value of the cumulative amount of replenished toner. Accordingly, the boundary between the area 101E where the remaining amount of toner is large and the area 1023 where the remaining amount of toner is small is different from the boundary between the two areas 101A and 102A of FIG. 8.

If the calculated value of the cumulative amount of replenished toner and the cumulative number of pixels are equally changed when the remaining amount of toner is calculated on the basis of only a calculated value of the cumulative amount of replenished toner, the correct remaining amount of toner is calculated as shown at a straight line I and a warning meaning that the remaining amount of toner is small is displayed at the point of time where the remaining amount of toner reaches 25%.

Meanwhile, if the change of the calculated value of the cumulative amount of replenished toner is large and the change of the cumulative number of pixels is small, for example, the current position moves along a straight line II. When the remaining amount of toner is still 45%, a warning meaning that the remaining amount of toner is small is displayed. In this case, whether the current position is changed along the straight line I or the straight line II is not clear in some apparatuses. Accordingly, the remaining amount of toner is displayed as 25% even in this case. However, after the remaining amount of toner is displayed as 25%, a good number of sheets to be printed can be used and a user feels uncomfortable.

Meanwhile, in contrast to this, if it is considered that the change of the calculated value of the cumulative amount of replenished toner is small, the change of the cumulative number of pixels is large, and the current position moves along a straight line III, a warning meaning that the remaining amount of toner is 25% is displayed at the point of time where the remaining amount of toner is 5%. In this case, a user expects the number of printed sheets corresponding to 25% of the remaining amount of toner. However, since the remaining amount of toner is actually 5%, the current position immediately reaches an empty area. As a result, a user feels uncomfortable even in this case.

Figure 10:
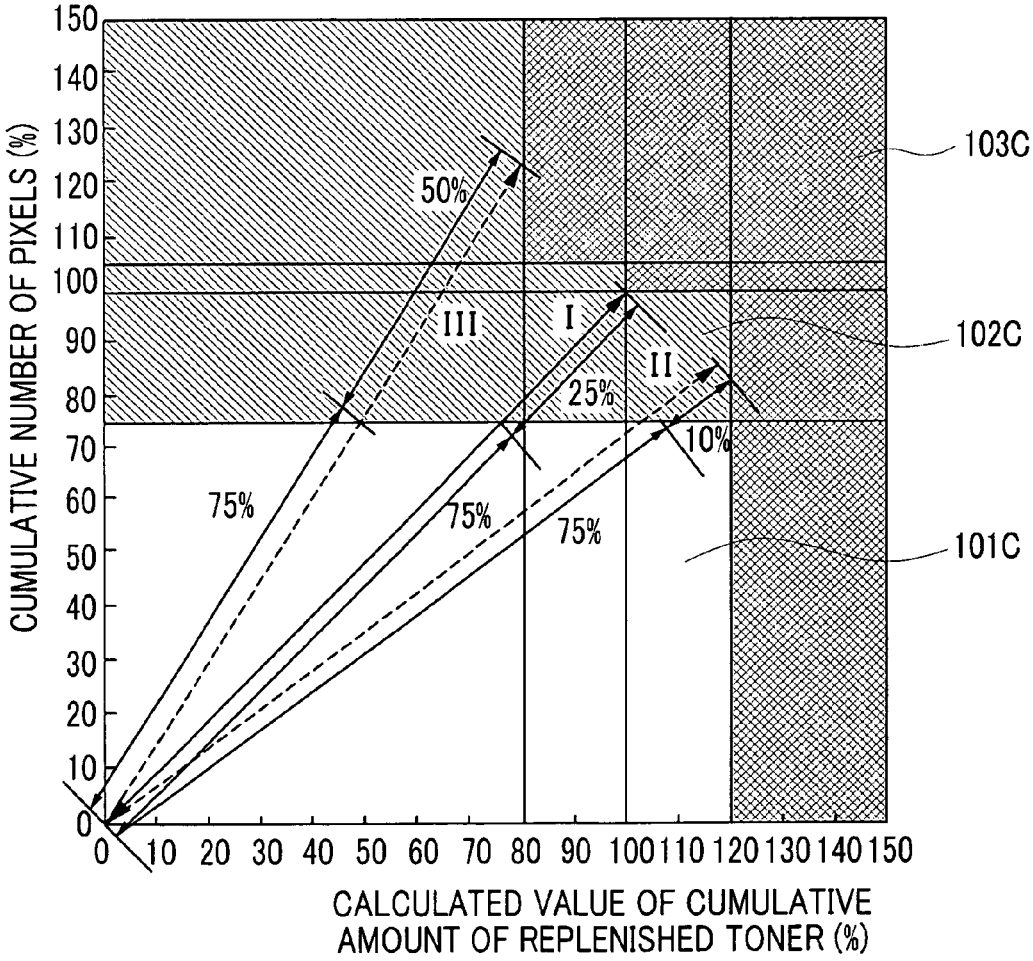
FIG. 10 is a view showing a remaining amount space when the remaining amount of toner is calculated on the basis of only a value of the cumulative number of pixels.

FIG. 10 is a view showing a remaining amount space when the remaining amount of toner is calculated on the basis of only a value of the cumulative number of pixels.

Areas 1010, 1020, and 1030 correspond to the areas 101A, 102A, and 103A shown in FIG. 8, respectively. The area 103C is an empty area where the remaining amount of toner is defined as 0%, and the area 1030 has the extent that is equal to the extent of each of the empty areas 103A and 103B shown in FIGS. 8 and 9. In contrast to this, here, the remaining amount of toner is calculated on the basis of only the cumulative number of pixels. Accordingly, the boundary between the area 1010 where the remaining amount of toner is large and the area 102C where the remaining amount of toner is small is different from the boundary between the two areas 101A and 102A of FIG. 8 and the boundary between the two areas 101B and 102B of FIG. 9.

If the calculated value of the cumulative amount of replenished toner and the cumulative number of pixels are equally changed when the remaining amount of toner is calculated on the basis of only the cumulative number of pixels, the correct remaining amount of toner is calculated as shown at a straight line I and a warning meaning that the remaining amount of toner is small is displayed at the point of time where the remaining amount of toner reaches 25%.

Meanwhile, if the change of the calculated value of the cumulative amount of replenished toner is large and the change of the cumulative number of pixels is small, for example, the current position moves along a straight line II. A warning meaning that the remaining amount of toner is small is displayed at the point of time where the remaining amount of toner is decreased to 10%. In this case, whether the current position is changed along the straight line I or the straight line II is not clear in some apparatuses. Accordingly, the remaining amount of toner is displayed as 25% even in this case. A user expects the number of printed sheets corresponding to 25% of the remaining amount of toner. However, since the remaining amount of toner is actually 10%, the life of the toner container has come to an end when a small number of sheets are printed after the display of the warning. As a result, a user feels uncomfortable.

In contrast to this, even when the change of the calculated value of the cumulative amount of replenished toner is small, the change of the cumulative number of pixels is large, and the current position moves along a straight line III, a warning meaning that the remaining amount of toner is 25% is displayed at a stage where the remaining amount of toner is 50%. As a result, a user also feels uncomfortable.

Figure 11:
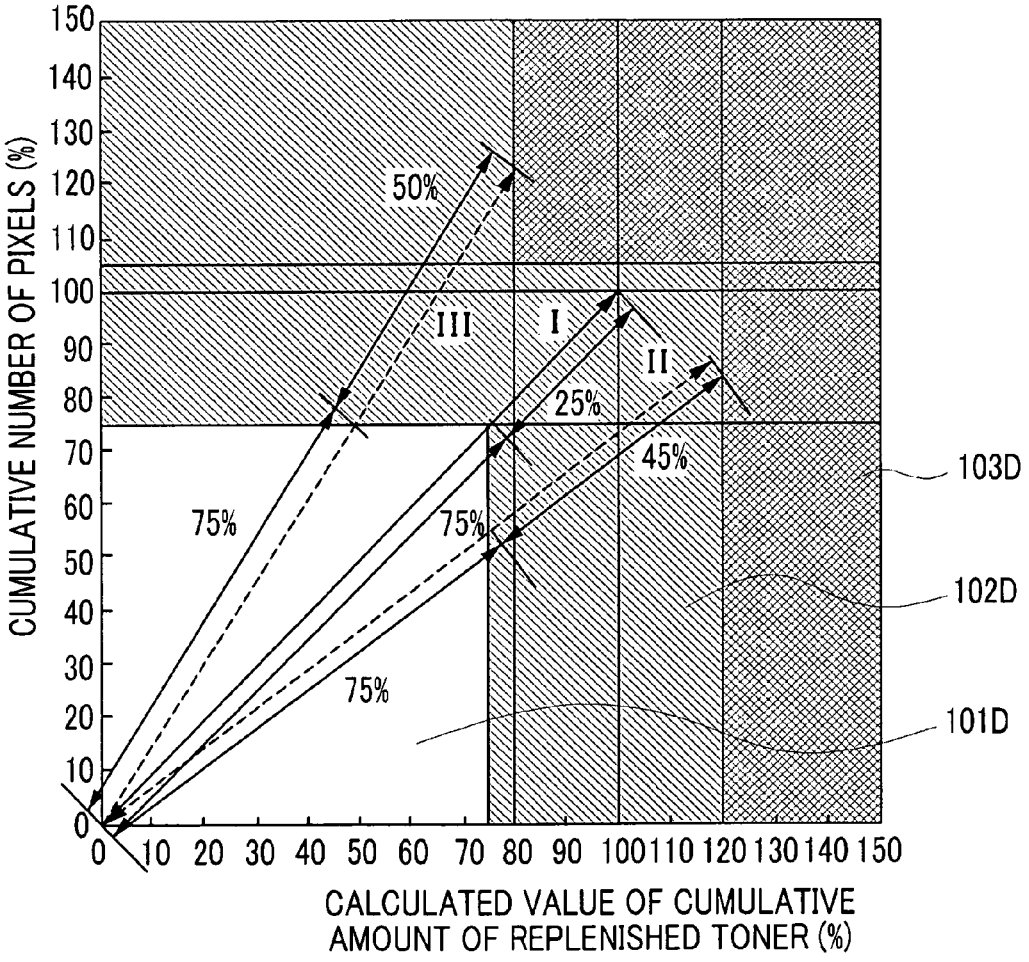
FIG. 11 is a view that is based on both a calculated value of the cumulative amount of replenished toner and the cumulative number of pixels but shows a remaining amount space when a warning is displayed for the faster one of them.

FIG. 11 is a view that is based on both a calculated value of the cumulative amount of replenished toner and the cumulative number of pixels but shows a remaining amount space when a warning is displayed for the faster one of them.

Here, areas 101D, 102D, and 103D also correspond to the areas 101A, 102A, and 103A shown in FIG. 8, respectively. The area 101D is an empty area where the remaining amount of toner is defined as 0%, and the area 103D has the extent that is equal to the extent of each of the empty areas 103A, 103B, and 103C shown in FIGS. 8 to 10. Meanwhile, the boundary between the area 101D where the remaining amount of toner is large and the area 102D where the remaining amount of toner is small is different from each of the boundary between the two areas 101A and 102A of FIG. 8, the boundary between the two areas 101B and 102B of FIG. 9, and the boundary between the two areas 101C and 102C of FIG. 10 due to the difference between the algorithms for calculating the remaining amount of toner.

Even in FIG. 11, when the calculated value of the cumulative amount of replenished toner and the cumulative number of pixels are normally changed, the current point moves along a straight line I inclined by an angle of 45° and a warning is displayed at the point of time where the remaining amount of toner reaches 25%. Meanwhile, if the calculated value of the cumulative amount of replenished toner proceeds prior to the cumulative number of pixels, the calculated value of the cumulative amount of replenished toner is employed. For example, if the current position moves along a straight line II, a warning meaning that the remaining amount of toner is 25% is displayed when the remaining amount of toner is 45%. Further, if the cumulative number of pixels proceeds prior to the calculated value of the cumulative amount of replenished toner, the cumulative number of pixels is employed. For example, if the current position moves along a straight line III, a warning meaning that the remaining amount of toner is 25% is displayed when the remaining amount of toner is 50%.

That is, a user feels significantly uncomfortable in the case of the algorithm that is shown in FIG. 11 and employs the faster one of the calculated value of the cumulative amount of replenished toner and the cumulative number of pixels.

Although not shown, a small amount of toner remains and a warning meaning that the remaining amount of toner is 25% is displayed in the case of an algorithm that employs the slower one of the calculated value of the cumulative amount of replenished toner and the cumulative number of pixels. For this reason, a user feels significantly uncomfortable even in this case.

According to the algorithm of this exemplary embodiment described with reference to FIG. 8, the natural remaining amount of toner, which causes a user not to feel uncomfortable, is calculated or displayed in comparison with the algorithms of FIGS. 9 to 11 and the like.

Here, process control is used in the above-mentioned exemplary embodiment to determine whether a toner contained in a developer stored in the developer unit runs short. However, instead of process control, in terms of the life of a toner container, a sensor for detecting the concentration of a toner may be provided in the developer unit and whether a toner contained in a developer stored in the developer unit runs short may be determined on the basis of a signal from the sensor.

Further, here, the calculated value of the cumulative amount of replenished toner and the cumulative number of pixels have been employed as an example of plural primary remaining amounts of the invention. However, for example, a primary remaining amount based on capacitance as disclosed in JP-A-2001-92232 may be employed as an example of plural primary remaining amounts of the invention. Furthermore, two primary remaining amounts, which are a calculated value of the cumulative amount of replenished toner and the cumulative number of pixels, have been employed in the above-mentioned exemplary embodiment. However, for example, three primary remaining amounts, which include a primary remaining amount based on capacitance in addition to a calculated value of the cumulative amount of replenished toner and the cumulative number of pixels, may be employed and a three-dimensional space, which uses these three primary remaining amounts as variables, may be employed as a remaining amount space.

In addition, an example where the invention is applied to the copying machine shown in FIGS. 1 and 2 has been described here. However, the invention is applied to not only a copying machine but also various kinds of image forming apparatuses, which have an image forming function, such as a printer and a facsimile machine.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

image holding bodies that hold latent images by being subjected to exposure and hold toner images by being developed with toners;

developer units that form toner images by developing the latent images held on the image holding bodies with toners;

a transfer unit that transfers the toner images formed on the image holding bodies to a recording medium;

a fixing unit that fixes the transferred toner images to the recording medium;

a container mounting portion on which toner containers storing replenishing toners to be supplied to the developer unit are replaceably mounted; and a remaining toner amount calculating unit that calculates an amount of toner remaining in the toner container mounted on the container mounting portion, wherein the remaining toner amount calculating unit includes a primary calculator that calculates a plurality of primary remaining amounts by calculating the amount of toner remaining in the toner container on the basis of bases different from each other, respectively, a storage unit that stores empty area data of a remaining amount space where an empty area, where the toner container is empty, in a remaining amount space, which uses the plurality of primary remaining amounts as variables, is defined, and a secondary calculator that refers to the empty area data stored in the storage unit, and calculates a ratio of a distance between current coordinates and a point reaching the empty area to a distance between an origin and the point reaching the empty area on a straight line, which passes through the origin where the toner container is not in use and the current coordinates that are defined by the plurality of primary remaining amounts calculated in the primary calculator in the remaining amount space, as the current remaining amount of toner.

2. The image forming apparatus according to claim 1, wherein the remaining toner amount calculating unit calculates the current amount of toner remaining in one toner container at different intervals of time, and maintains the current remaining amount of toner calculated last time as the current remaining amount of toner if the current remaining amount of toner calculated this time is larger than that calculated last time.

3. The image forming apparatus according to claim 2, further comprising:

an exposure unit to which image data are input and which forms latent images on the image holding bodies by exposing the image holding bodies according to the image data; and a toner replenishing member that replenishes toner to the developer units from the toner container mounted on the container mounting portion, wherein the primary calculator calculates two primary remaining amounts by calculating the amount of toner remaining in the toner container on the basis of the image data and a toner replenishing operation of the toner replenishing member, respectively, and the secondary calculator calculates the current remaining amount of toner on the basis of only the primary remaining amount, which is calculated on the basis of the image data, of the two primary remaining amounts until the primary remaining amount, which is calculated on the basis of the image data, of the two primary remaining amounts reaches a first threshold after a new toner container is mounted on the container mounting portion.

4. The image forming apparatus according to claim 3, further comprising:

a remaining toner amount warning unit that warns that the remaining amount of toner calculated in the remaining toner amount calculating unit has reached a second threshold.

5. The image forming apparatus according to claim 4, further comprising:

a setting unit that variably sets the second threshold.

6. The image forming apparatus according to claim 2, further comprising:

a remaining toner amount warning unit that warns that the remaining amount of toner calculated in the remaining toner amount calculating unit has reached a second threshold.

7. The image forming apparatus according to claim 6, further comprising:

a setting unit that variably sets the second threshold.

8. The image forming apparatus according to claim 1, further comprising:

an exposure unit to which image data are input and which forms latent images on the image holding bodies by exposing the image holding bodies according to the image data; and a toner replenishing member that replenishes toner to the developer units from the toner container mounted on the container mounting portion, wherein the primary calculator calculates two primary remaining amounts by calculating the amount of toner remaining in the toner container on the basis of the image data and a toner replenishing operation of the toner replenishing member, respectively, and the secondary calculator calculates the current remaining amount of toner on the basis of only the primary remaining amount, which is calculated on the basis of the image data, of the two primary remaining amounts until the primary remaining amount, which is calculated on the basis of the image data, of the two primary remaining amounts reaches a first threshold after a new toner container is mounted on the container mounting portion.

9. The image forming apparatus according to claim 8, further comprising:

a remaining toner amount warning unit that warns that the remaining amount of toner calculated in the remaining toner amount calculating unit has reached a second threshold.

10. The image forming apparatus according to claim 9, further comprising:

a setting unit that variably sets the second threshold.

11. The image forming apparatus according to claim 1, further comprising:

a remaining toner amount warning unit that warns that the remaining amount of toner calculated in the remaining toner amount calculating unit has reached a second threshold.

12. The image forming apparatus according to claim 11, further comprising:

a setting unit that variably sets the second threshold.

* * * * *